US005749250A

United States Patent [19]

Kim

[11] Patent Number: 5,749,250

[45] Date of Patent: May 12, 1998

[54] WASHING MACHINE

[76] Inventor: Hae In Kim, 940-22, Sihewng-3dong, Kuro-ku, Seoul, 152-033, Rep. of Korea

[21] Appl. No.: 666,365

[22] PCT Filed: Feb. 14, 1995

[86] PCT No.: PCT/KR95/00011

§ 371 Date: Aug. 6, 1996

§ 102(e) Date: Aug. 6, 1996

[87] PCT Pub. No.: WO95/21954

PCT Pub. Date: Aug. 17, 1995

[30] Foreign Application Priority Data

Feb. 14, 1994 [KR] Rep. of Korea ..... 1994/2573
Jan. 24, 1995 [KR] Rep. of Korea ..... 1995/1235

[51] Int. Cl.[6] ..... D06F 27/00

[52] U.S. Cl. ..... 68/171; 68/23.1

[58] Field of Search ..... 68/23.1, 23.2, 68/23.3, 155, 156, 171, 172, 173, 174; 366/240; 134/117

[56] References Cited

U.S. PATENT DOCUMENTS 1,363,275 12/1920 Sargent ..... 68/173
2,512,408 6/1950 Abresch ..... 68/156 X
2,565,150 8/1951 Stageberg ..... 68/156

FOREIGN PATENT DOCUMENTS 949820 3/1949 France ..... 68/156
1298275 3/1987 Russian Federation ..... 68/23.3
895588 5/1962 United Kingdom ..... 68/172

*Primary Examiner*—Philip R. Coe
*Attorney, Agent, or Firm*—Ladas & Parry

[57] ABSTRACT

A washing machine has a case constituting an external shell. The case has at least one wall defining sides of the case. One of the sides has an integral guide at a center of the one side. A washing vessel slides within the guide and has an inside and detachably coupled sealing cap on an opening into the inside. A shaker is coupled with the washing vessel for shaking the washing vessel and a balancer is mounted to an inside of the at least one wall for supporting the shaker from the at least one wall, for absorbing vibrations of the shaking relative to the case and for maintaining a balance of the case.

7 Claims, 4 Drawing Sheets

WASHING MACHINE

TECHNICAL FIELD

The present invention relates to a washing machine in which a washing vessel of the washing machine is oscillated up and down to carry out a washing.

BACKGROUND ART

Generally, in the conventional washing machines, a washing vessel is rotated by the action of a motor, or vanes installed on the bottom of the washing vessel are rotated, thereby washing the articles to be washed.

In such conventional washing machines having the above described structure, when the water in the washing vessel is rotated, the articles to be washed are also rotated. Therefore, the frictions between the washing water and the articles to be washed are very weak, with the result that the washing performance is lowered. In order to solve this problem, the washing vessel or the vanes are rotated in the forward and reverse directions repeatedly so as to produce eddy currents. Thus the frictions between the water and the articles to be washed are increased, so that the washing would be improved, this being the typical conventional method.

The problems of this conventional washing method are such that first the articles to be washed are twisted, and the articles to be washed are entangled with each other. Second, rotation speed of the washing vessel or the vanes is limited (usually 100–400 rpm), and therefore, strong water currents and waves can not be generated, with the result that the cleaning quality is worse than a hand wash. Third, in order to improve the cleaning quality, an auxiliary device such as an air bubble generating device is required. Fourth, the rotating directions for the washing vessel or the vanes have to be reversed from the forward direction to the reverse direction repeatedly.

These problems are common to the washing methods in which water currents are produced through the rotations of the washing vessel or the vanes.

DISCLOSURE OF INVENTION

The present invention is intended to overcome the above described disadvantages of the conventional techniques.

Therefore it is an object of the present invention to provide a washing machine in which a washing vessel containing water and articles to be washed is sealed up, and then the washing vessel is oscillated to make the air within the vessel broken into micro air bubbles, and to make the tiny air pores pass through the articles to be washed so as to clean up the articles to be washed, and in which strong water currents and strong waves are generated to improve the cleaning performance.

It is another object of the present invention to provide a washing machine in which the twisting of the washed articles is maintained to the minimum, and the washing is completed within a short period of time.

In achieving the above objects, the washing machine according to the present invention includes: a case; a washing vessel installed within the case, and having a detachably coupled sealing cap; a shaking means firmly coupled with the bottom of the washing vessel for oscillating the washing vessel; and a balancing means for supporting the shaking means, for absorbing the vibrations, and for maintaining a balance.

BRIEF DESCRIPTION OF THE DRAWINGS

The above and other objects, and features of the present invention will become apparent from the following descriptions taken in conjunction with the accompanying drawings, where in.

MODE FOR CARRYING OUT THE INVENTION

Figure 1:
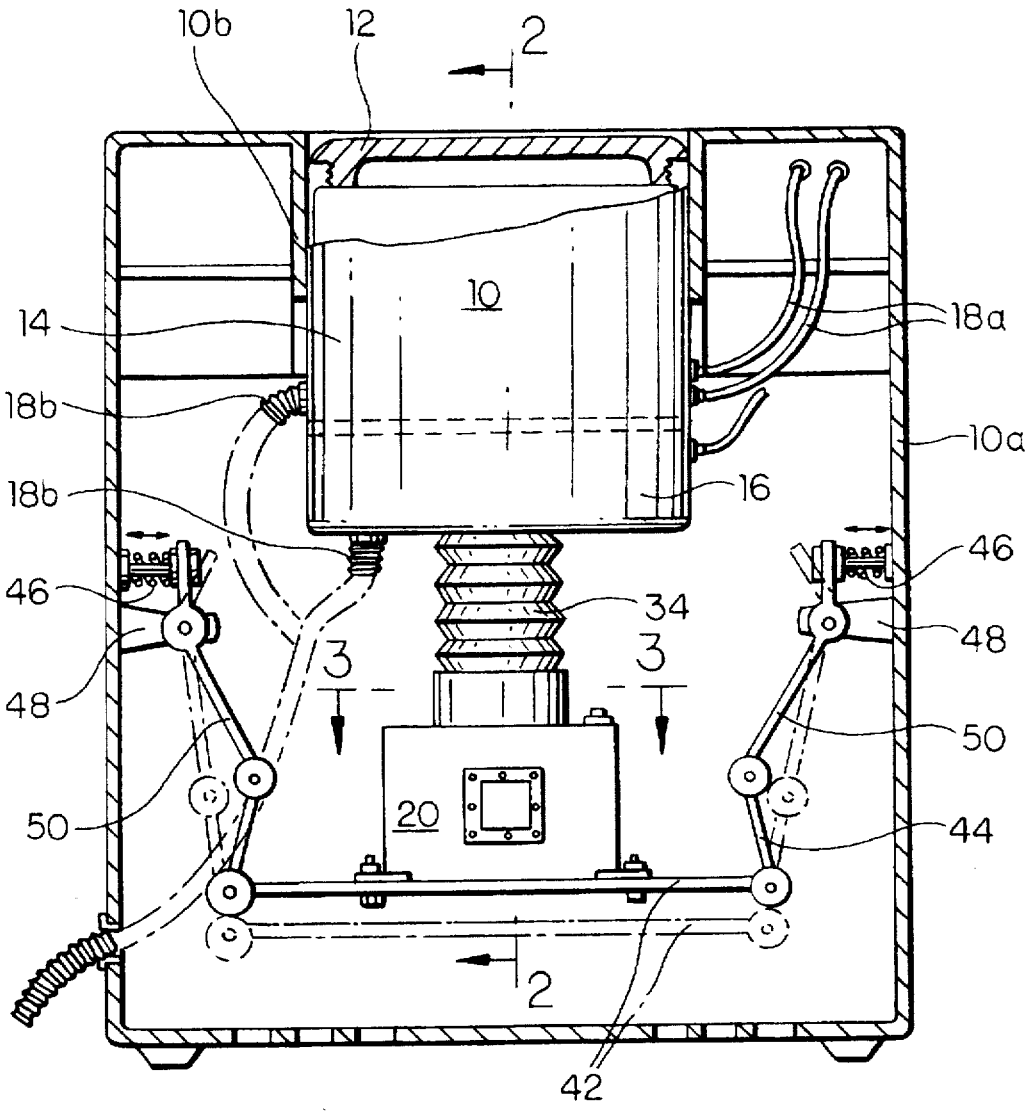
FIG. 1 shows a longitudinal sectional view of the washing machine according to the present invention, showing the critical portion thereof

Referring now to FIG. 1, there is a longitudinal sectional view of the washing machine in accordance with a preferred embodiment of the present invention, showing the critical portion thereof. The washing machine according to the present invention includes: a washing vessel 10 for accommodating a washing water and washing articles; a shaking means for oscillating the washing vessel; a balancing means for supporting the shaking means, for absorbing the vibrations, and for maintaining a balance; and a case 10*a* for supporting the balancing means and for surrounding the washing vessel, the shaking means and the balancing means.

Referring to FIG. 1, there as shown in this drawing is a sectional view taken along a line A—A of FIG. 1, a sealing cap 12 is threadably coupled with the top of the washing vessel 10. The washing vessel 10 is partitioned into a washing room 14 for accommodating a washing water and washing articles and a spare room 16 for adjusting the weight of the washing vessel 10. The washing room 14 and the spare room 16 are respectively attached with water supply hoses 18*a* and water draining hoses 18*b*.

The outer circumference of the washing vessel 10 is slidably coupled with the inner circumference of a guide 10*b* of the case 10*a*.

The shaking means is coupled with the bottom of the washing vessel 10 for shaking the washing vessel 10. In the embodiment of the present invention, the shaking means oscillates the washing vessel up and down, and descriptions will be made based on this embodiment.

The shaking means for carrying out the above described functions includes a crank device which converts a rotating power to a reciprocating power. The crank device includes: a rotatably installed crank shaft 21; a crank weight 22; a crank arm 24; a crank pin 26; a piston rod 28 rotatably connected to the crank pin; a piston 30 connected to the piston rod 26; a cylinder 31 for accommodating the reciprocating movements of the piston 30; and a housing 20 surrounding all the cranking parts. Owing to the reciprocating movements of the piston 30, the washing vessel 10 is oscillated up and down.

Now this will be described in more detail.

The shaking means includes: a crank shaft 21 rotatably coupled with both ends on a housing 20, and having a passive pulley 23 at one end thereof; a crank weight 22 coupled with the crank shaft 21 and having a certain weight; a crank arm 24 extending from the crank weight 22, and connected with a crank pin 26; a piston rod 28 with one end connected to the crank pin 26, and with another end rotatably connected to a piston 30; and a connecting member 32 with one end connected to the piston and with another end connected to the bottom of the washing vessel 10.

The connecting member 32 is surrounded by a bellows 34 which is made of rubber. The housing 20 is provided with an oil inlet and an oil outlet, and the oil inlet and the oil outlet are sealingly closed with screw caps, so that the oil of the interior would not be leaked.

Figure 3:
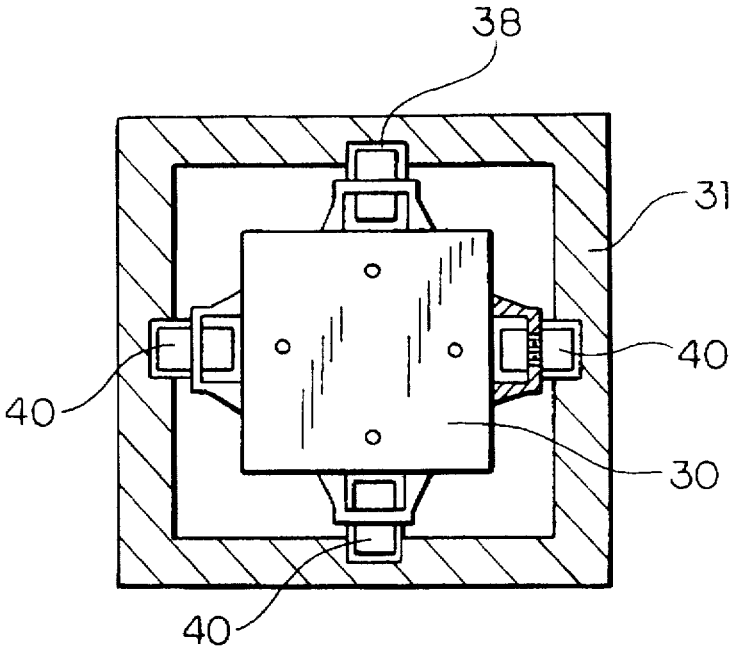
FIG. 3 shows a sectional view taken along a line B—B of FIG. 1.
Figure 4:
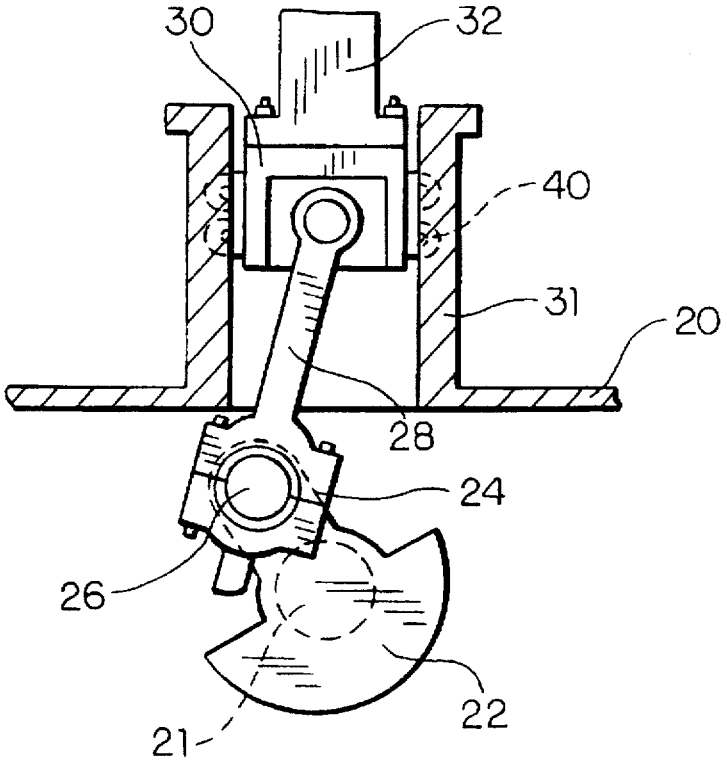
FIG. 4 shows a side view of a shaking means in accordance with a preferred embodiment of the present invention, i.e., a cylinder and a crank of a crank case.

Further, the faces on which the piston 30 and the cylinder 31 contact to each other are formed in a special pattern, so that the piston 30 would perform smooth sliding reciprocating movements, and that the noise would be kept to the minimum. For this purpose, as shown in FIG. 3, the cross section of the cylinder 31 is formed rectangular, and a groove 38 is formed on each inner wall of the cylinder 31 in the lengthwise direction (vertical direction). Each of the four sides of the piston 30 is provided with a roller 40, so that the rollers 40 would be fit into the grooves 38, and that the piston 30 would be freely move up and down within the cylinder 31.

In the drawing, the cross sections of the cylinder 31 and the piston 30 are rectangular, but they may be round. That is, on the round surfaces, grooves can be formed in the vertical direction at certain intervals, and rollers can be provided so that the rollers would be fit into the grooves, thereby obtaining the same effect.

In the shaking means which is constituted as described above, the elements enclosed in the housing 20 receive a revolving power from a passive pulley 23 to perform interlocked movements, and to shake the washing vessel 10, with the result that vibrations are produced. These vibrations have to be damped, so that the life expectancy of the washing machine can be extended.

Therefore, as shown in FIG. 1, the shaking means is supported by a balancing means.

Link members 44 are installed at the both sides of the case in a symmetrical manner, and therefore, only those which are disposed on one side will be described. Therefore, the same part are assigned with same reference codes.

The balancing means includes: a base frame 42 disposed in the horizontal direction separated from the bottom of the case 10*a* for supporting the housing 20; a plurality of link members 44 pivotally coupled to the both ends of the base frame 42; a balancing lever 50, with its one end pivotally connected to one end of the link member 44, and the other end pivotally coupled with a supporting bracket 48 projecting from the inner wall of the case 10*a*, and also connected to an elastic body 46 projecting from the inner wall of the case 10*a*.

The washing machine of the present invention constituted as above mentioned will now be described as to its operation and effect.

As shown in FIG. 1, first, a certain amount of articles to be washed is put into the washing vessel 10, and then, the top of the washing vessel 10 is sealingly closed with a sealing cap 12. Meanwhile, the washing water is supplied through the supply hose up to a certain level. If the supply of water is insufficient, there is the possibility that the washing articles may be damaged, and therefore, the water supply should be sufficient.

Meanwhile, if the crank weight 22 and the crank arm 24 are assumed to be symmetrically disposed around the crank shaft 21, the weight of the crank weight 22 will be equal to the total weight of the crank arm 24 and other connected parts. In this circumstances, the vibrations of the housing 20 and the washing vessel 10 will be kept to the minimum during the operation of the washing machine.

Therefore, when the washing articles are put into the washing vessel after measuring their weight with a scale and the like, and when the water is supplied, it is desirable that the total loaded weight of the washing vessel should be equal to the weight of the crank weight 22. Therefore, during the manufacturing of the washing machine, the washing vessel should be designed such that the total weight of the washing articles and water should not exceed the weight of the crank weight. If the weight of the washing articles and water is smaller than the weight of the crank weight, the unbalance should be compensated.

In order to compensate such an unbalance, a spare room 16 is provided under the washing room 14, so that water can be supplied through a supply hose 18*a* into the spare room 16 as much as to be compensated. After filling the spare room 16 with water, a drain hole which is closed or opened by a solenoid valve is properly opened, so that the balance can be maintained. Here, the spare room 16 is provided with the usual water level gauge such as a floating gauge, so that the water level can be made known.

As the above mentioned, thus, after putting washing articles into the washing room 14, the washing room 14 is sealingly closed with a sealing cap 12. Then, if a power source is connected, a motor (not shown) drives the passive pulley 23 which is coupled to the crank shaft 21. Then the crank weight, the crank pin, and the crank arm which are enclosed within the housing 20 are driven, so that the piston rod 28 and the piston 30 would perform reciprocating movements in the vertical direction.

Therefore, the connecting member 32 which is firmly connected to the piston 30 causes the washing vessel 10 to perform reciprocating movements up and down.

When the washing vessel 10 performs reciprocating movements up and down, the air above the water level within the washing vessel 10 is broken into small babbles to be mixed with the washing water.

Figure 5:
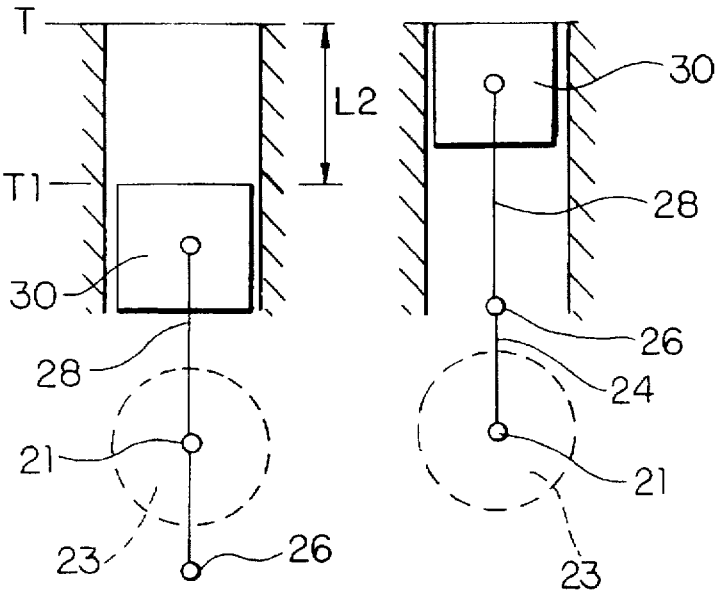
FIG. 5 shows a schematic illustration of an upper dead point and a lower dead point of the crank of the washing machine in accordance with the present invention.
Figure 6:
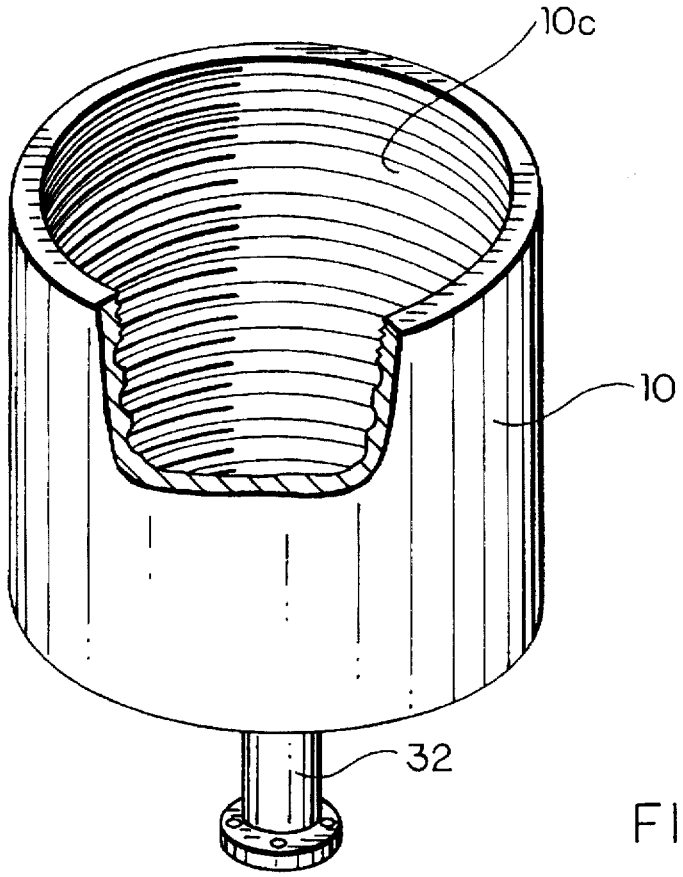
FIG. 6 shows a partly cut-out perspective view of the washing vessel in accordance with the present invention.

As shown in FIG. 5, the movements of the washing vessel 10 are limited to between the upper dead point T and the lower dead point T1 of the piston 30. Initially, when the washing vessel 10 moves from the upper dead point T to the lower dead point T1, or from the lower dead point T1 to the upper dead point T, and when the washing articles and the washing water move owing to their inertia, the air is broken into fine drops, with the result that water comes to contain large amounts of fine air pores. At the same time, wild water currents and waves are generated, so that washing can be done by the air bubbles and water currents.

The velocity of the piston is zero at the upper and lower dead points, and is maximum at the middle point between the upper and lower dead points T and T1. Therefore, after several seconds from the initial stage, the washing vessel and the washing water move at almost same velocity. However, in actual, the washing water lags behind as much as the height L1 of the air-filled space.

Therefore, if it is assumed that the average velocity (m/sec) of the water is indicated by V, if the piston stroke (the stroke of the washing vessel) is indicated by L, and if the revolution speed (rpm) of the crank shaft is N, then the average water velocity becomes: $V=(2LN)/(60)=(LN)/(30)$.

As can be seen in the above formula, when the crank shaft revolves one round, the washing vessel performs one return reciprocating movement, and therefore, the total moving distance of the washing vessel becomes 2L. Further, when the crank shaft revolves N times, the total moving distance of the washing machine becomes 2LN, and therefore, in order to obtain the moving distance per second, 2LN is divided by 60.

According to the above formula, the velocity of the water current is determined by the revolution speed of the crank shaft. Therefore, as the revolution speed of the crank shaft is increased, so much the washing ability is improved.

Figure 2:
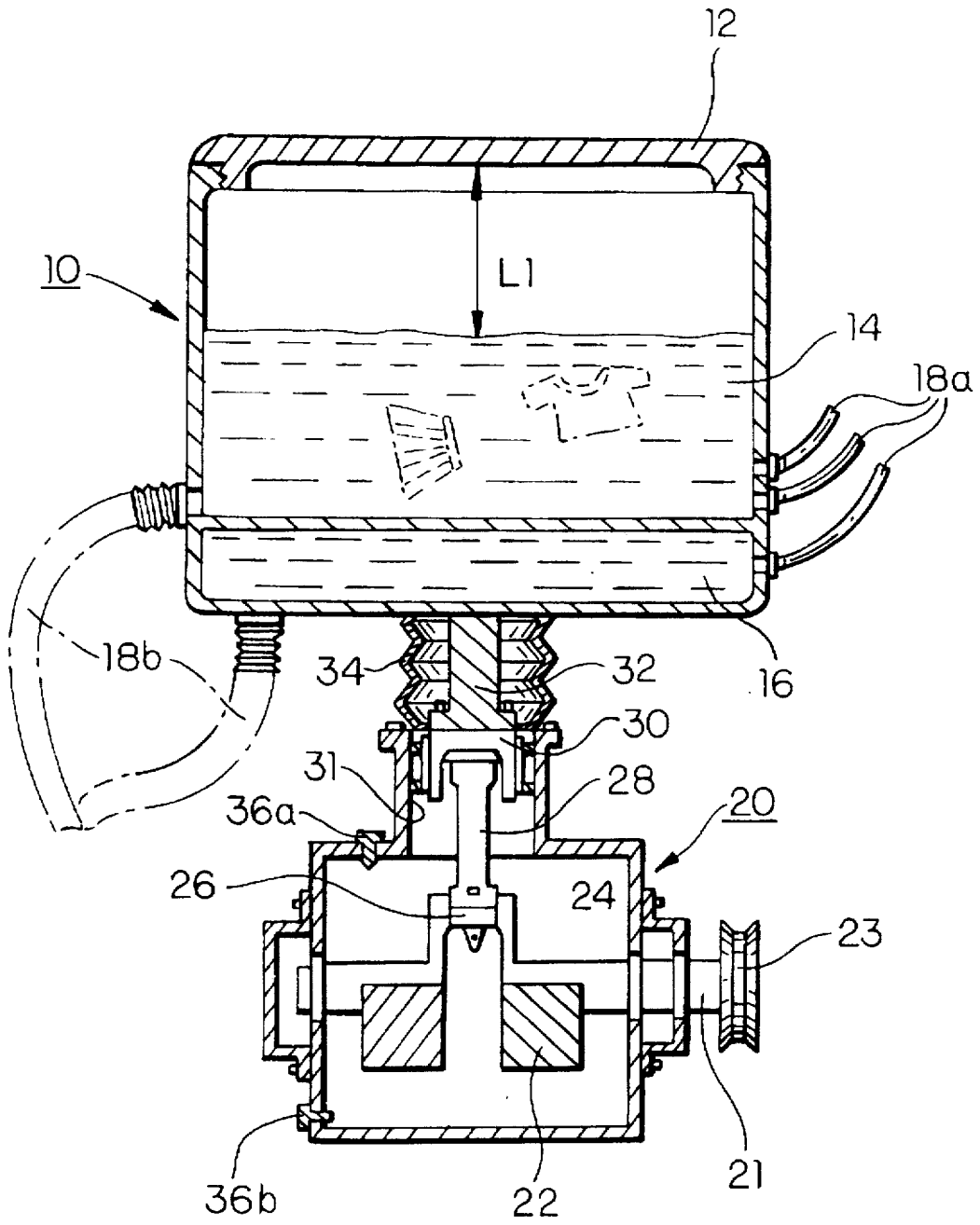
FIG. 2 shows a sectional view taken along a line A—A of FIG. 1.

Further, as shown in FIG. 2, the height L1 of the vacant space of the washing vessel above the water and the washing articles corresponds to the distance over which the washing water performs reciprocating movements between the bottom of the sealing cap 12 and the bottom of the washing vessel 10. Further, the total volume of the air bubble which are mixed with the water is equivalent to the volume of the air layer (vacant space) above the washing water and the washing articles. Thus it is desirable that a proper volume of the air layer (vacant space) is left, so that air bubbles would be formed to wash the washing articles.

For example, the washing time and the washing ability are different depending on the revolution speed of the crank shaft. However, the height L1 of the vacant space and the piston dstroke L2 were set to a ratio of 1:1, and the volume of the washing water including the washing articles and the volume of the vacant space were set to a ratio of 4:1. Under this arrangement, when a washing was carried out by driving the crank shaft at 600 rpm for 30 minutes, a satisfactory washing result was obtained.

If a faster washing is to be carried out, the revolution speed of the crank shaft can be increased, so that a satisfactory washing effects can be obtained within a short period of time.

Further, in order to an improved washing result during the reciprocating movements of the washing vessel up and down, a plurality of horizontal annular grooves 10*c* are provided on the inner circumference of the washing vessel 10, so that eddy currents of water would be produced during the reciprocating movements of the washing vessel, and that a three-dimensional washing would be possible.

When the washing is carried out by shaking the washing vessel, not only the washing vessel is shaken, but also the housing 20 is oscillated. Therefore, a balancing means for supporting the housing 20 is provided to absorb the oscillations of the crank case and the washing vessel, and to absorb the noise. Thus the constituting members are made to operate more smoothly. This will be described in more detail below.

As shown in FIG. 1, at the moment when the washing vessel begins to return after being moved upward or downward, the washing water currents which drift between the bottom of the sealing cap 12 and the bottom of the washing vessel 10 collide each other. From these collisions, vibrations and oscillations occur, and therefore, these vibrations and oscillations are absorbed in the following manner. That is, a base frame 42 is made to support the housing 20, and the both ends of the base frame 42 are connected to link members 44. The link members 44 are pivotally connected to balancing levers 50, and the upper end of the balancing lever 50 is connected to an elastic body 46. Thus the impacts which acts on the base frame 42 upward and downward are elastically absorbed and offset. The elastic body 46 includes a tension or compression spring which tends to be restored to the original state.

According to the present invention as described above, strong water currents and micro air bubbles are produced to improve the washing performance, and the twisting and entangling of the washing articles are prevented.

As the above mentioned, the present invention was described based on the preferred embodiment, but it should be apparent to the ordinarily skilled in the art that various changes and modifications can be added without departing from the technical conception of the present invention. These changes and modifications should come within the scope of the present invention which is limited only by the appended claims.

What is claimed is:

1. A washing machine comprising:

a case (10*a*) for constituting an external shell of a washing machine, said case having at least one wall defining sides of said case, one of said sides having an integral guide (10*b*) at a center of said one side;

a washing vessel (10) for sliding within said guide and having an inside and detachably coupled sealing cap (12) on an opening into said inside;

shaking means coupled with said washing vessel for shaking said washing vessel; and balancing means mounted to an inside of said at least one wall for supporting said shaking means from said at least one wall, for absorbing vibrations of said shaking relative to said case, and for maintaining a balance of said case.

2. The washing machine of claim 1, wherein said washing vessel (10) has a plurality of horizontal annular grooves (10*c*) on said inside of said washing vessel at certain intervals.

3. The washing machine of claim 1, wherein said shaking means comprises:

a housing (20);

a crank shaft (21) rotatably coupled at opposite ends to said housing and having a pulley (23) at one of said ends for rotating said crank shaft;

a crank weight (22) coupled with one side of said crank shaft for counterbalance;

a crank arm (24) extending from an opposite side of said crank shaft to a crank pin (26);

a piston (30);

a piston rod (28) with one end connected to said crank pin rotatable relative to said crank arm and another end rotatably connected to said piston; and a connecting member (32) with one end connected to said piston and another end connected to said washing vessel.

4. The washing machine of claim 3, and further comprising:

a cylinder (31) for said piston that has inner walls in a rectangular cross section.

5. The washing machine of claim 4, and further comprising:

grooves (38) in a lengthwise direction at intervals on said inner walls of said cylinder; and rollers (40) on said piston for mating with said grooves to make said piston move smoothly.

6. The washing machine of claim 1, and further comprising a partition for partitioning said inside of said washing vessel into a washing room (14) and a spare room (16).

7. The washing machine of claim 1, wherein said balancing means comprises:

a base frame (42) disposed in a space between said washing vessel and said case for said support of said shaking means, said base frame having opposite ends;

link members (44) pivotally coupled at one end respectively to said opposite ends of said base frame;

supporting brackets (48) and elastic bodies (46) each having one end projecting from said at least one wall; and balancing levers (50) with one end pivotally connected respectively to another end of said link members, an opposite end respectively connected to said one end of said elastic bodies, and a pivotal coupling between said one and opposite ends respectively to said one end of said supporting brackets.

* * * * *